US005347773A

United States Patent [19]

Thil

[11] Patent Number: 5,347,773

[45] Date of Patent: Sep. 20, 1994

[54] RIGID COVER ASSIGNMENT FOR SWIMMING POOL OR BASIN

[76] Inventor: Albert J. Thil, 76, rue Pierre Brossolette, 92140 Clamart, France

[21] Appl. No.: 995,994

[22] Filed: Dec. 23, 1992

[30] Foreign Application Priority Data

Dec. 27, 1991 [FR] France ..... 91 16251

[51] Int. Cl.[5] ..... E04H 4/06

[52] U.S. Cl. ..... 52/169.7; 52/64; 52/126.5; 4/495

[58] Field of Search ..... 4/495, 501, 505, 514; 52/125.1, 126.5, 169.7, 64

[56] References Cited

U.S. PATENT DOCUMENTS

| | | | |
|---|---|---|---|
| 3,935,600 | 2/1976 | Scribner | 4/495 |
| 4,419,776 | 12/1983 | Schmidt | 4/495 X |
| 4,918,766 | 4/1990 | Leonaggeo, Jr. | 4/495 |

FOREIGN PATENT DOCUMENTS

| | | | |
|---|---|---|---|
| 271402 | 6/1988 | European Pat. Off. | 52/645 |
| 3538337 | 2/1990 | European Pat. Off. | 52/169.7 |
| 2258127 | 5/1974 | Fed. Rep. of Germany | 4/495 |
| 2548574 | 5/1976 | Fed. Rep. of Germany | 4/495 |
| 3004789 | 8/1981 | Fed. Rep. of Germany | 52/169.7 |
| 3342444 | 1/1985 | Fed. Rep. of Germany | 52/169.7 |
| 23408 | 11/1901 | United Kingdom | 52/125.1 |

*Primary Examiner*—Carl D. Friedman
*Assistant Examiner*—Kevin D. Wilkens
*Attorney, Agent, or Firm*—McAulay Fisher Nissen Goldberg & Kiel

[57] ABSTRACT

A cover arrangement together with a displacement mechanism for a swimming pool having a basin (1). The displacement mechanism moves the cover vertically inside the basin (1) of the swimming pool between two extreme positions. One position is a bottom (7) and the other position is a surface of the pool. The cover arrangement comprises sealing shutters which are movably supported on a support structure (9) in such a way that they can occupy an open position and a closed position. The support structure (9) is provided with plurality of partitions, each of which can be sealed by at least one shutter. The displacement mechanism is also suitable to position and maintain the supporting structure (9) in at least a third position situated between the extreme positions.

19 Claims, 6 Drawing Sheets

RIGID COVER ASSIGNMENT FOR SWIMMING POOL OR BASIN

The present invention concerns a rigid cover arrangement for a swimming pool or basin, particularly a submersible cover arrangement having a plurality of panels.

As is well known, it is desirable for a number of reasons that swimming pools, particularly outdoor swimming pools, be provided with a cover which is arranged over the opening of the pool when not in use.

In particular, this cover prevents dead leaves or other foreign bodies carried in the air, rain water, etc., from polluting the basin so as to render it unfit for bathing.

Such a cover, if produced in a sufficiently resistant construction, likewise constitutes a safety device against accidental falls, particularly of children.

Moreover, a cover enhances the comfort of the pool indoors by reducing the level of humidity in the room in which the pool is located, and outdoors by decreasing the heat losses which routinely take place during the course of the night.

On the other hand, it is known that a pool, even one of modest dimensions, occupies space which could have other, more appropriate uses in certain cases. Such a restriction is even more regrettable when the periods during which the pool may be used over the year are further reduced due to climatic conditions. By covering the pool with an easily removable, sufficiently sturdy cover the lost surface area taken up by the swimming pool can be recovered for other uses.

Thus, it has been suggested to cover swimming pools with a cover made up of rigid members which can be rolled up like those used in roller shutters. This particularly complicated system is formed by a series of watertight slats of polyvinyl chloride, or PVC, which are articulated with one another and can be rolled onto a drum driven by an electric motor in such a way that the slats slide into openings provided for this purpose on each side of the pool. In addition to their inconvenient arrangement in elevated containers of considerable volume, covers of this type have the disadvantage of a high manufacturing cost which particularly limits their application.

In order to avoid the problem posed by the bulkiness of the container, it has been proposed in the patent DE-A-3 342 444 to make the cover submersible. To this end, the cover is moved by the slats which are filled with or emptied of water when acted upon by compressed air in such a way that they can occupy two respective positions, namely a first position at the bottom of the pool and a second position at the surface of the water contained in the pool. Although such an arrangement for closing off the surface of the pool has the advantage that it can be used in pools whose bottom is both sloping and level, it prevents the use of a deep end for diving, since this would be covered by the cover in the operating state for use of the pool.

Finally, it has been suggested to remove the cover from the pool when the pool is in use by raising it above the level of the water. For this purpose, four vertical posts having a chain and rack arrangement are distributed along the circumference of the pool and enable the cover to be raised and concealed, e.g. in a ceiling. However, apart from the high cost and unattractive appearance of this type of installation, it has the disadvantage when used outdoors that it partly obscures the sunlight.

Thus, based on such considerations, it will be noted that while the different arrangements of the prior art enabling a covering of the surface of a swimming pool satisfy one or the other specific need in their individual ways, none of the proposed arrangements has so far brought about an efficient solution to all of the problems encountered. Moreover, most of the suggested solutions are particularly expensive to implement so that their use is reserved for applications entailing a large budget.

The present invention has the object of overcoming these disadvantages by providing an arrangement for covering a pool which is sufficiently rigid to allow other uses for the upper surface of the swimming pool when not in use, can be operated simply and quickly, is attractive, and finally has an affordable manufacturing cost.

Thus, the object of the present invention is a cover arrangement for a swimming pool which is vertically movable inside the pool between two extreme positions, namely the bottom and the surface of the pool, by displacement means. The arrangement includes sealing shutters which are movably supported on a support structure in such a way that they can occupy an open position and a closed position, characterized in that the support structure is planar and rigid and forms a plurality of compartments or partitions, each of which can be sealed by at least one shutter, the displacement means being suitable for positioning and maintaining the structure in at least a third position situated between the aforementioned extreme positions.

In a mode of realizing the invention, the vertical displacement means of the support structure include a plurality of scissor elements, that is, elements in the form of an X having two articulated legs whose upper ends are arranged so as to slide in said support structure and serve to support the latter, the lower ends being supported at the bottom of the pool on movable members in the plane of the latter which permit the support structure to be raised by moving said lower ends together or lowered by moving these lower ends apart.

In a variant of this mode of realizing the invention the movable members are formed by brackets integral, respectively, with an upper rack having downwardly directed teeth and a lower rack with upwardly directed teeth, these two racks engaging with a gear mechanism arranged between the two racks in such a way that when one of the racks is displaced in one direction as a result of the rotation of the gear mechanism, the other rack is displaced in the opposite direction.

In another mode of realizing the invention the movable members are two constructions which are situated opposite and parallel to one another and extend in the longitudinal or transverse direction of the basin. Parallel carriages extending perpendicularly to said constructions are fixed on the latter and alternate in such a way that two adjacent carriages are associated with opposite constructions, the respective bases of the legs of the same scissor element being supported in an articulated manner on two adjacent carriages so that all relative parallel displacement of the two constructions causes an identical displacement of the base of the legs.

In another mode of realizing the invention, the movable shutters are articulated around parallel axles which are swivelably supported on the vertical edges integral with the transverse members forming the support structure, the movable shutters being shaped in such a way that they overlap in at least one direction.

An embodiment form of the present invention is described in the following by way of example with reference to the attached drawing, without the invention being limited to this example:

Figure 1:
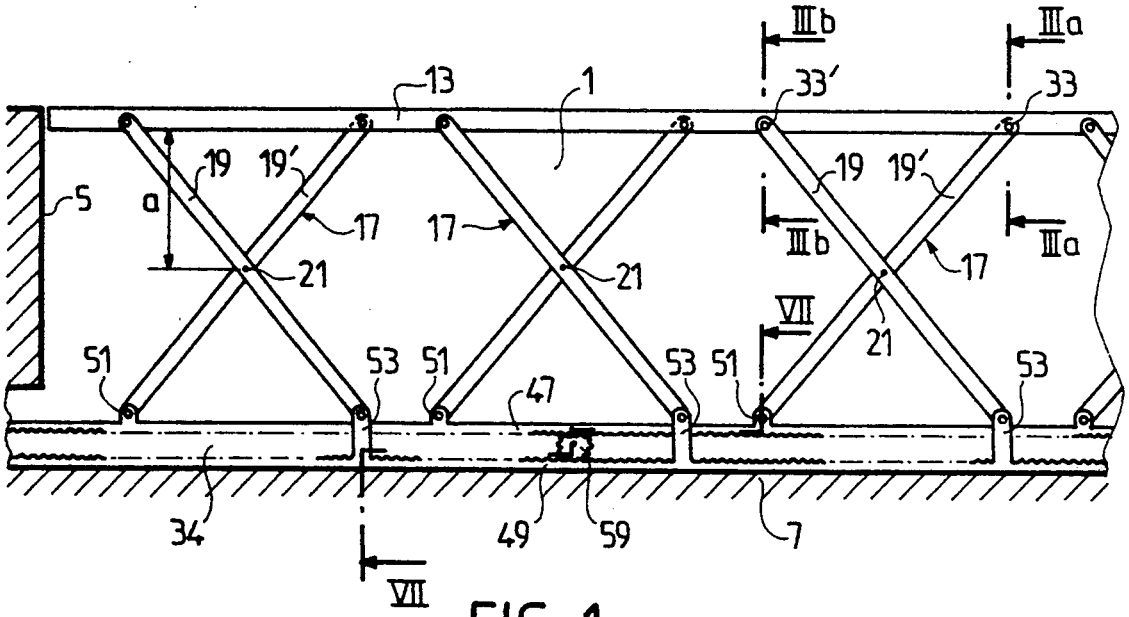
FIG. 1 shows a partial vertical and cross-sectional view of a swimming pool outfitted with a cover arrangement according to a mode of realizing the invention.
Figure 2:
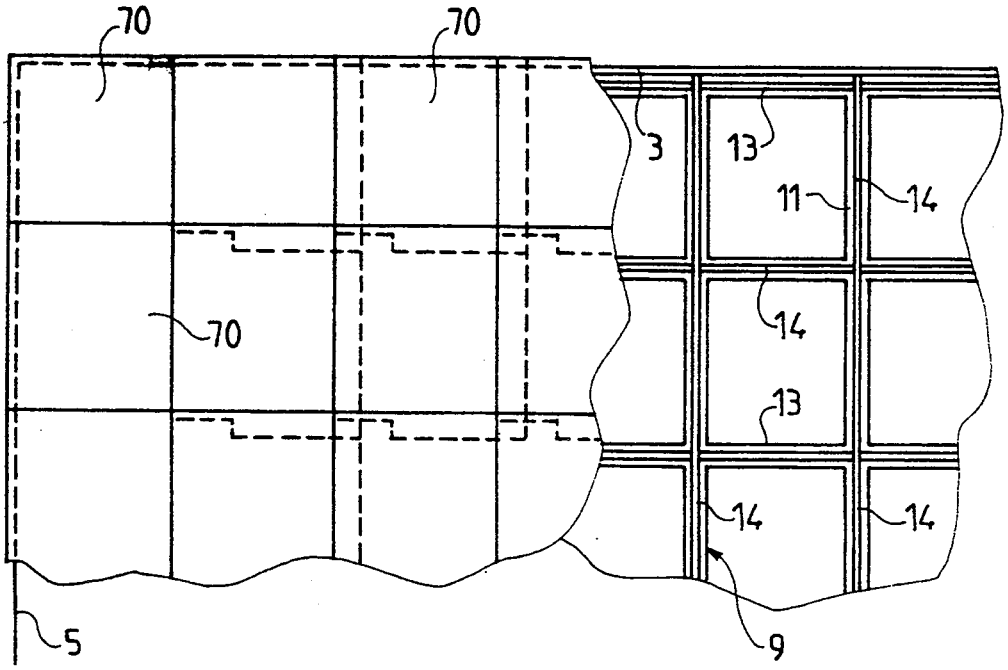
FIG. 2 shows a partial top view of the cover arrangement shown in FIG. 1 in which a portion of the shutters is removed.
Figure 3A:
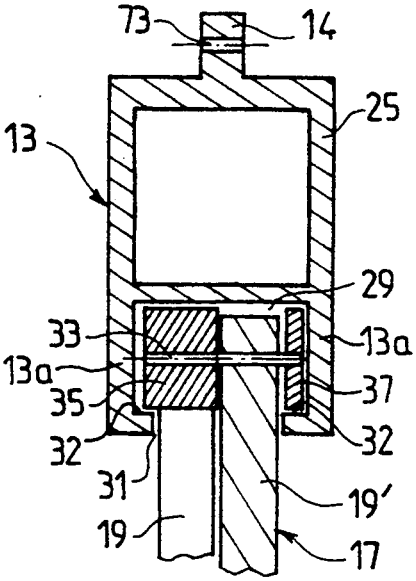
Figure 3B:
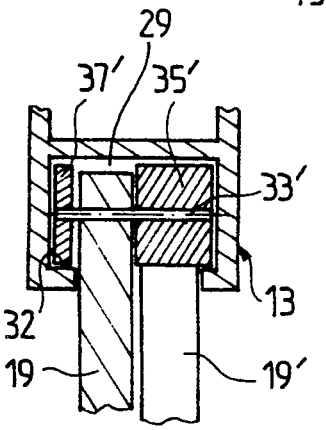
Figure 3C:
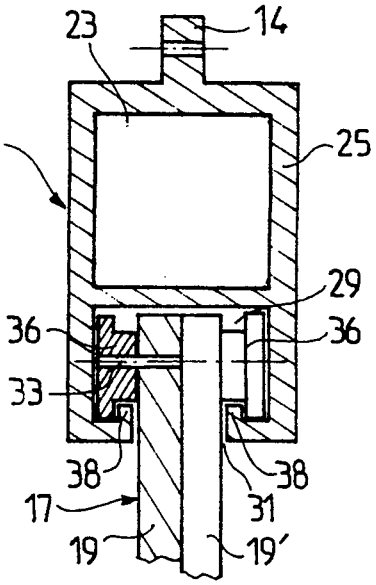
Figure 4:
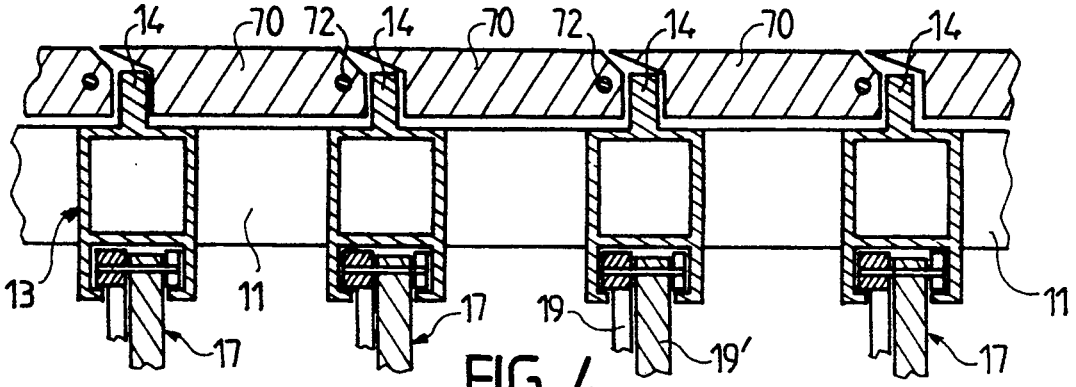
Figure 5:
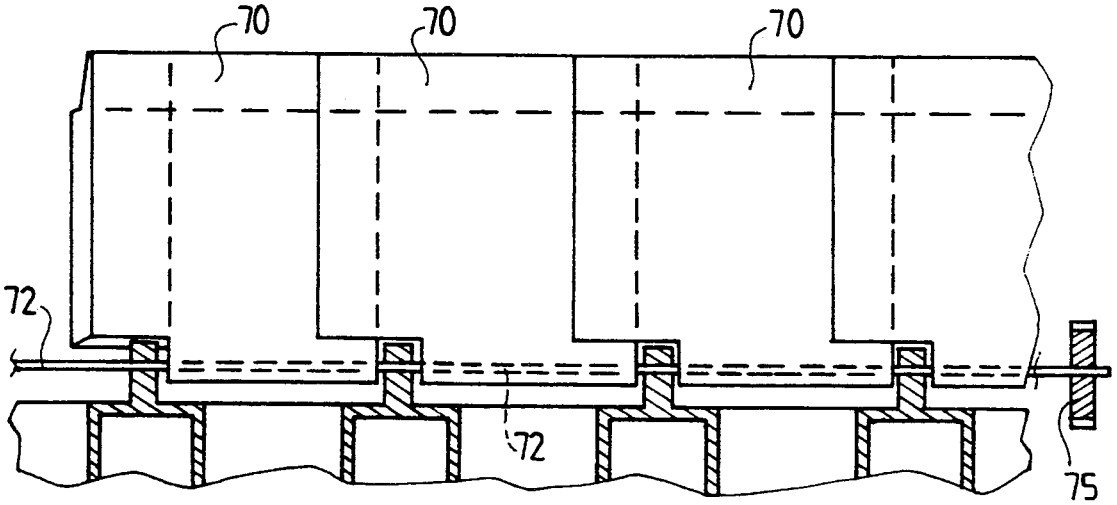
Figure 6:
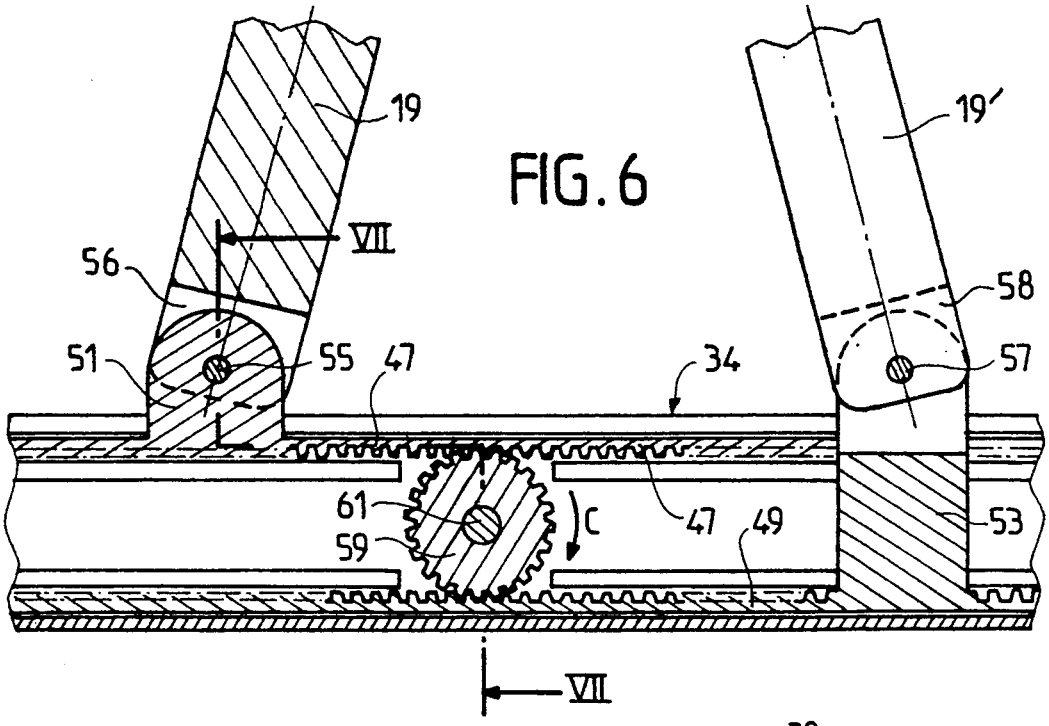
Figure 7:
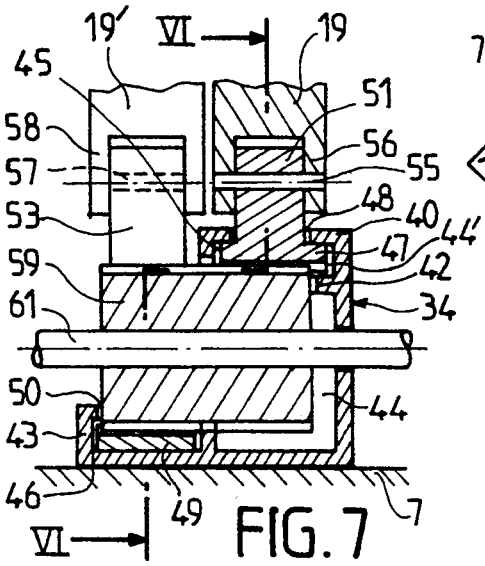
Figure 9:
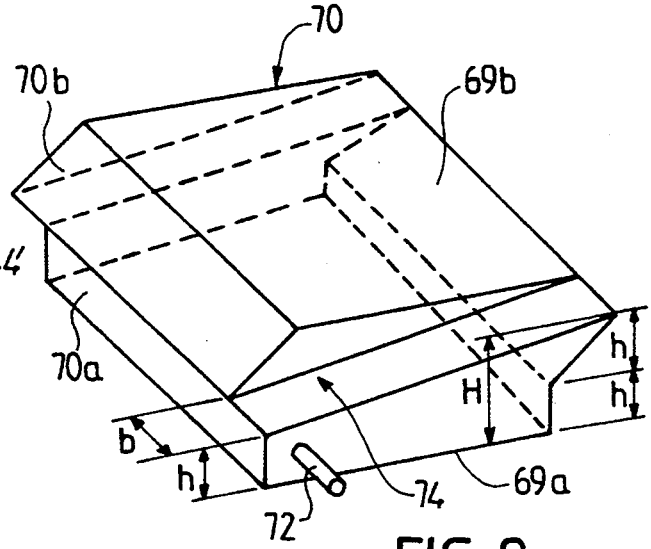
Figure 8:
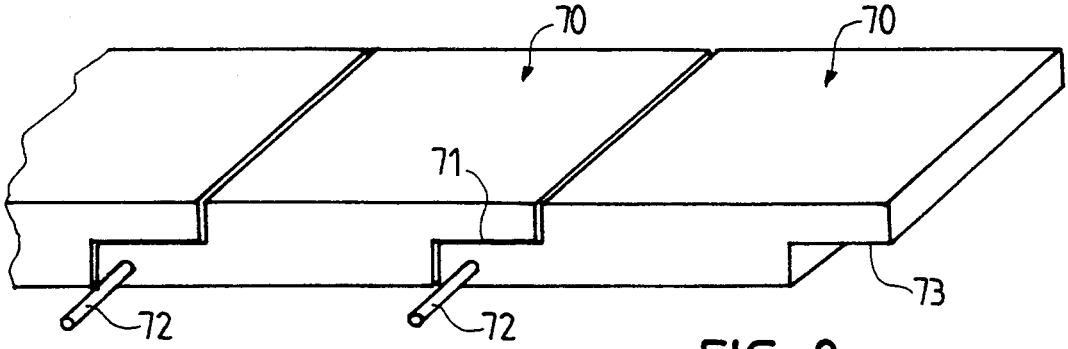
Figure 8A:
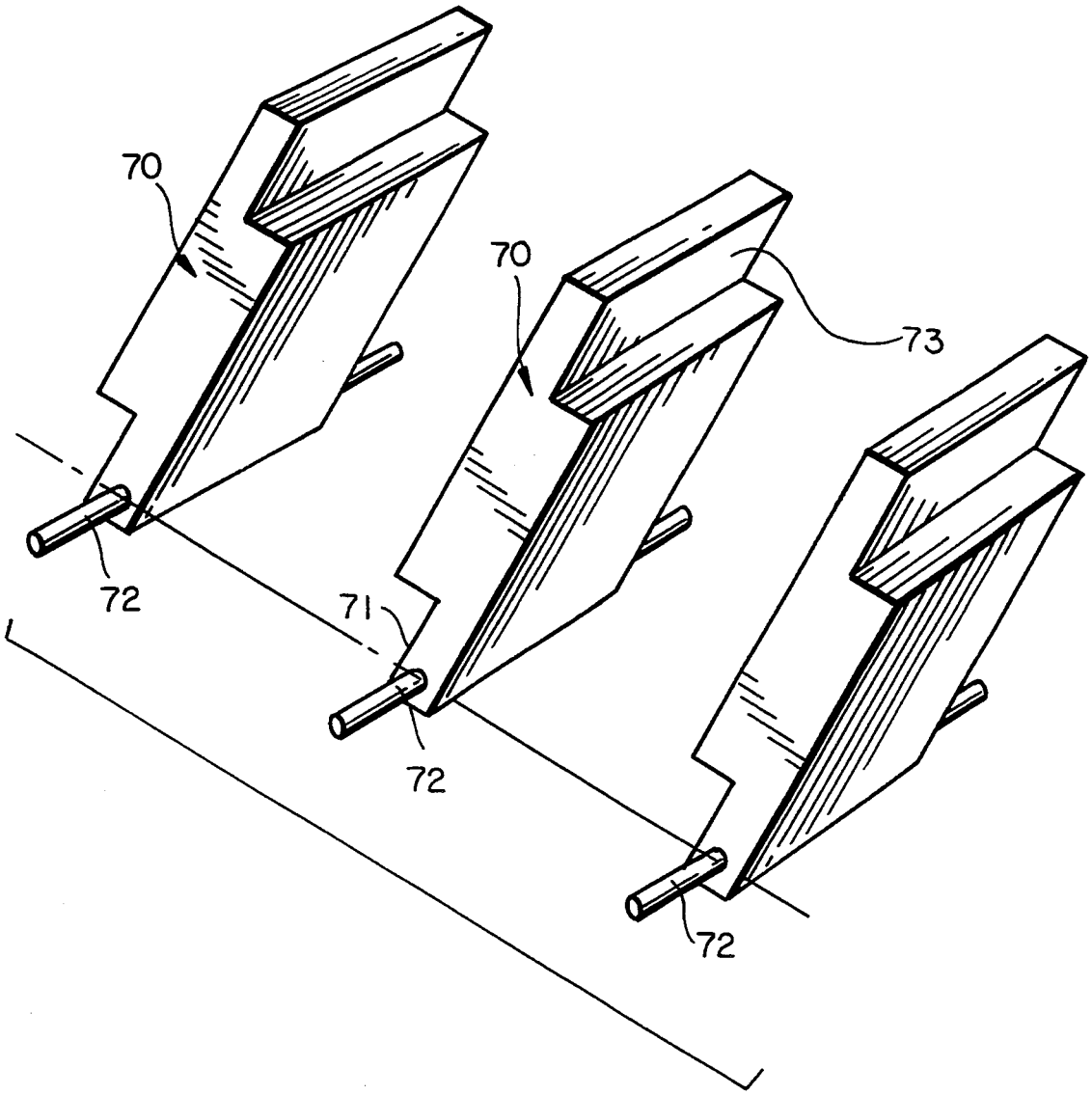
Figure 10:
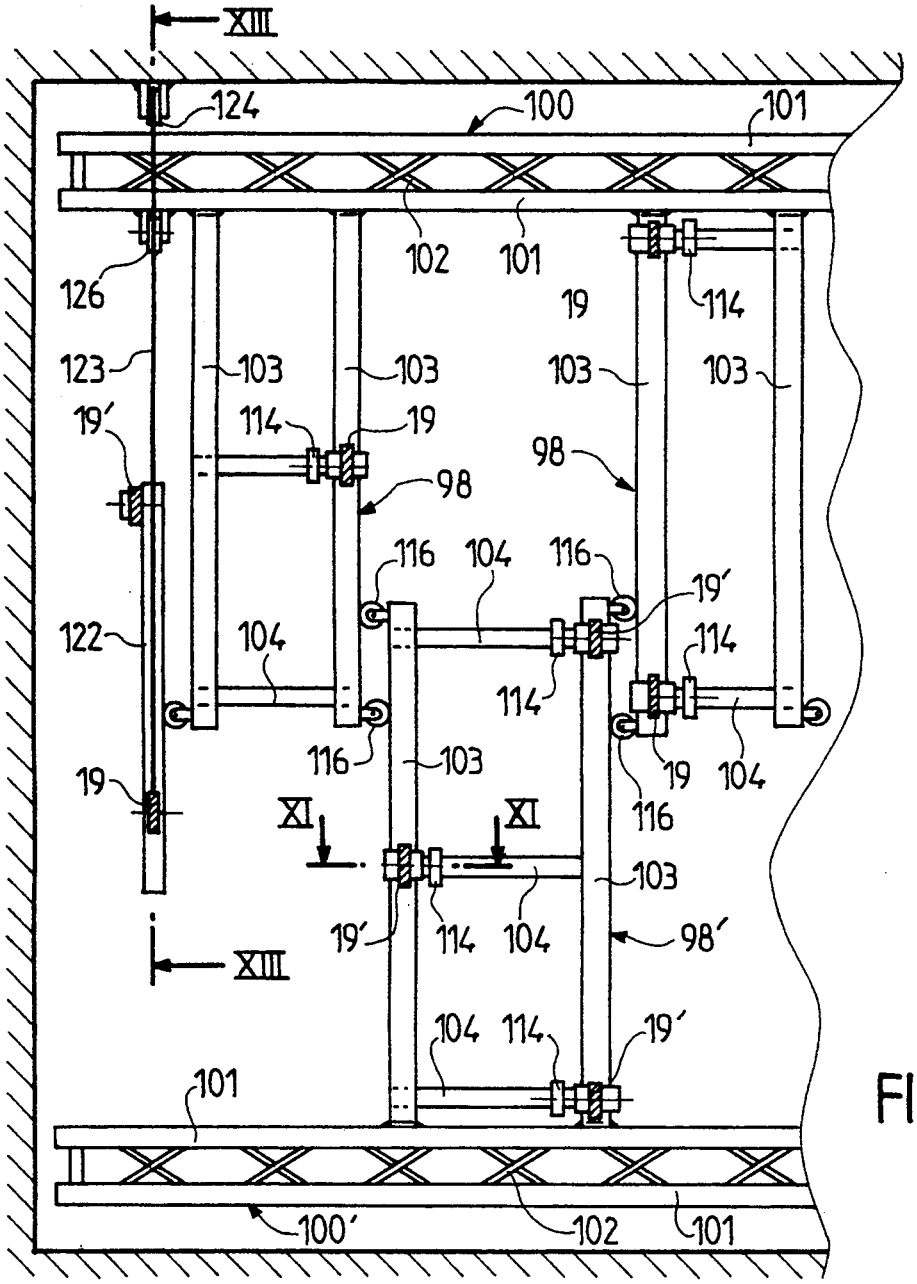
Figure 11:
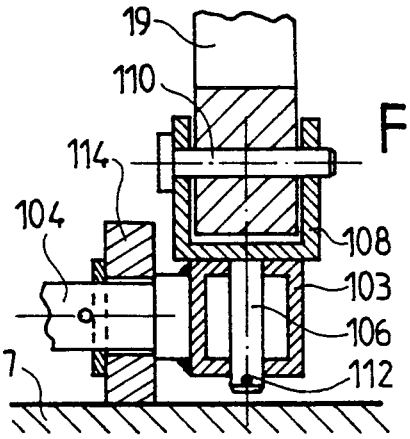
Figure 12:
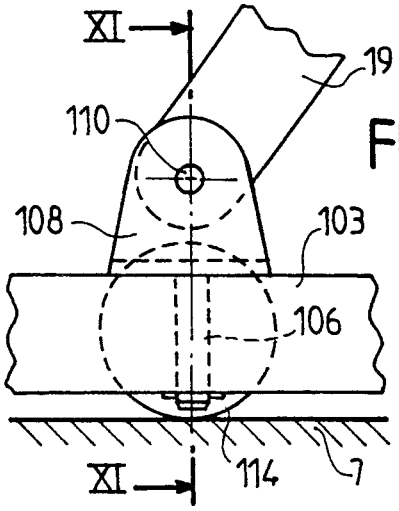
Figure 13:
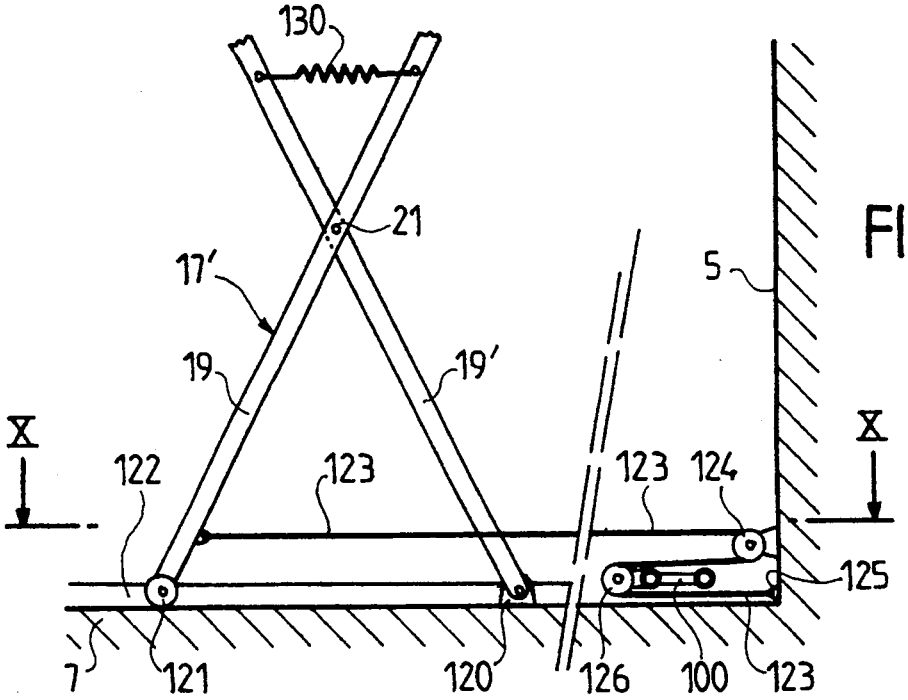
Figure 14:
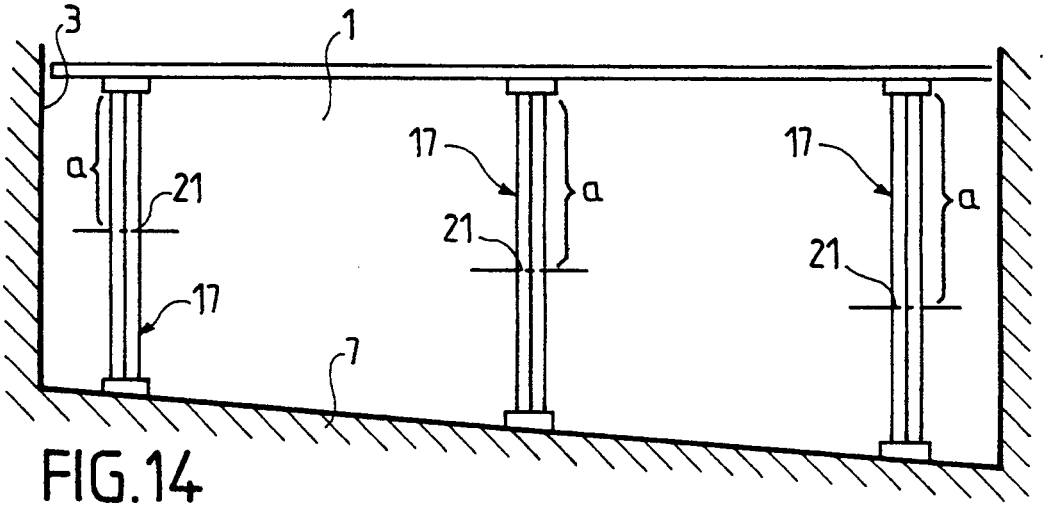
Figure 15:
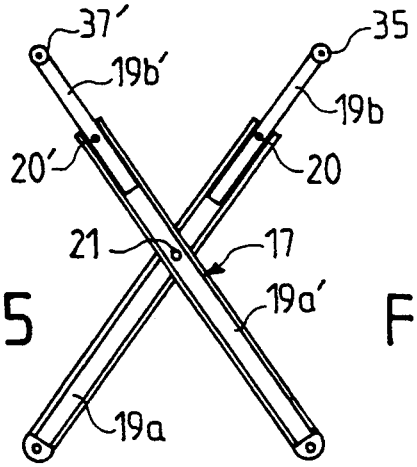
Figure 3D:
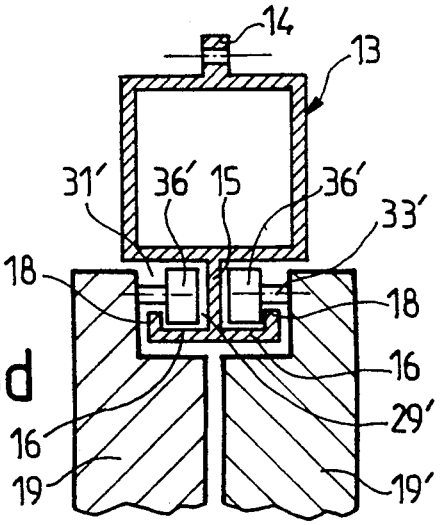

FIG. 3*a* shows a partial vertical and longitudinal section along line IIIa–IIIa of the cover arrangement shown in FIG. 1;

FIG. 3*b* shows a partial vertical and longitudinal section along line IIIb–IIIb of the cover arrangement shown in FIG. 1;

FIG. 3*c* shows a partial vertical and longitudinal section through a variant of the construction of the scissor elements according to the invention;

FIG. 3*d* shows a partial vertical and longitudinal section through another variant of the construction of the scissor elements according to the invention;

FIG. 4 shows a partial vertical and longitudinal section through the support structure of the cover arrangement, according to the invention, with its movable shutters in the closed position;

FIG. 5 shows a partial vertical and cross section with the movable shutters in the open position;

FIG. 6 shows a partial vertical and cross section along line VI—VI of FIG. 7 of means for controlling the displacement of the cover arrangement, according to the invention, in enlarged scale;

FIG. 7 shows a partial vertical and longitudinal section along line VII—VII of the cover arrangement shown in FIG. 6;

FIG. 8 shows a perspective view in enlarged scale of a mode of realizing the movable shutters according to the invention;

FIG. 8A shows a perspective view on an enlarged scale of a mode of realizing the movable shutters showing the shutters in a partially open position between the closed position of FIG. 8 and a fully open position of the movable shutters;

FIG. 9 shows a perspective view in enlarged scale of a variant of the mode of realizing the movable shutters according to the invention;

FIG. 10 shows a partial plan view of a variant of the means for controlling the displacement of the cover arrangement according to the invention;

FIG. 11 shows a partial vertical and longitudinal section in enlarged scale along line XI—XI of FIG. 12 of a detail of the realization of the variant shown in FIG. 10;

FIG. 12 is a partial front view through the detail of the realization shown in FIG. 11 in enlarged scale;

FIG. 13 is a schematic view in partial vertical section of the mode of realization shown in FIGS. 10 to 12;

FIG. 14 is a schematic view in vertical and longitudinal section of a variant of the realization of the invention;

FIG. 15 shows a front view of a variant of the scissor elements according to the invention;

FIGS. 12 and 13 are variants of the realization of the invention.

FIG. 1 shows a vertical and cross section of a swimming pool including a basin 1 defined by vertical transverse walls 3, vertical longitudinal walls 5, and by a bottom 7. A support structure 9 which includes partitioned elements formed by longitudinal members 11 and transverse members 13 which are assembled by any suitable means such as solder, glue, etc. is held in a horizontal position at the surface of the basin 1 by a series of scissor elements 17.

In the present example, the longitudinal and transverse members 11 and 13, respectively, are square metal sections of aluminum but, of course, sections produced from synthetic material may also be used. As shown in FIGS. 3*a* and 3*b*, the transverse members 13 continue at the bottom into two wings 13*a* forming a recess 29 which has a lower slot 31 formed along the entire length of its base and defines two support wings 32 at both sides of the latter 31. As can be seen in FIG. 3*a*, the longitudinal members 11 and transverse members 13 are provided at the top with a vertical rib 14 which extends along the entire length of the member.

The scissor elements 17 are formed by two legs 19, 19' which are articulated around a horizontal and longitudinal axis 21 substantially at their center in the present embodiment form. The upper end of each leg 19, 19' is provided with two rollers, namely, a first larger roller 35, 35' and a second smaller roller 37, 37', which are supported so as to be rotatable around the same horizontal axle 33, 33' and arranged at each side of the legs 19 and 19', respectively. These rollers are accommodated in the recess 29 and supported therein by the wings 32. In order to compensate for the deviation due to the thickness of the legs 19, 19', the rollers are arranged on one of the legs in such a way that the larger roller is situated on one side of this leg, while on the other leg the larger roller is situated on the other side. In this way the respective upper ends of the legs 19 and 19' are each displaceable in the same recess 29.

As shown in FIG. 3*c*, the upper ends of the legs 19 and 19' can have only one roller 36. In this case the rollers 36 are arranged on the exterior side of the legs 19 and 19'. An upwardly projecting flange 38 which engages in a circular depression of the roller 36 is provided on the inside of the support wings 32 so that the recess 29 can ensure a sufficient guidance of the rollers 36. Such an arrangement enables a standardized manufacture since the legs 19 and 19' are identical and at the same time allows the scissor elements 17 to be closed almost completely since the rollers 36 are arranged on the exterior side of the legs 19', 19''.

As shown in FIG. 3*d*, the lower portion of the transverse member 13 can include a central, vertical wing 15 which terminates at each side in two horizontal wings 16 which are provided at each end with an upwardly projecting flange 18 in such a way that two recesses 29' opening laterally toward the outside in a slot 31' are defined at each side of the vertical wing 15. The recesses 29' receive the rollers 36' which are supported so as to be rotatable around horizontal axles 33' integral with the respective ends of the legs 19 and 19'.

As shown in FIGS. 1, 6 and 7, a profiled metal member 34 is arranged on the bottom 7 of the basin 1 of the swimming pool, parallel to each of the transverse members 13. The profiled member 34 is formed by two hollow rectangular sections attached at their bases, namely a section member 40 and a section member 43. Section member 40 is divided by a horizontal partition 42 into a lower chamber 44 and an upper chamber forming an upper slide 45. Section member 43 forms a lower slide 46 having the same dimensions as the upper slide 45. The two slides 45 and 46 include an upper slot 48 and lower 50, respectively, extending along their entire length. The upper and lower slides 45 and 46, respectively, each receive a rack 47 and 49 having, respectively, downwardly and upwardly directed teeth. The racks 47 and 49 are provided in each instance with a plurality of connecting brackets, namely upper connecting brackets 51 and lower connecting brackets 53, on which caps 56, 58 provided at the lower ends of the legs 19 and 19' are articulated around the respective axles 55 and 57.

Each profiled member 34 has a toothed wheel 59 which is integral with a longitudinal drive shaft 61 parallel to the bottom of the basin 1 and engaging simultaneously with the lower and upper teeth of the two racks 47 and 49. This shaft 61 is driven in rotation by a motor, not shown in the drawing, whose rotating direction can be controlled depending on the desired displacement direction to be communicated to the support structure 9. Thus, the rotation of each of the toothed wheels 59 results in a translational displacement of the racks 47 and 49 in the slides 45 and 46 in opposite directions. A rotation of the shaft 61 in the clockwise direction C (in FIG. 6) causes the two connecting brackets 51 and 53, and accordingly the base of the legs 19 and 19' of the scissor elements 17, to be moved toward one another, which translates into an upward displacement of the upper ends of these legs 19 and 19' and thus into an upward displacement of the support structure 9. Conversely, a rotation of the shaft 61 in the counterclockwise direction causes the connecting brackets 51 and 53 to move apart, thus effecting a downward displacement of the support structure 9.

The present arrangement thus not only ensures a positioning of the support structure 9 at some level between the two extreme levels, i.e. the bottom 7 and the upper portion of the basin 1 of the swimming pool, but also maintains it in this position while the pool is in use. This makes it possible to adapt the depth of the pool to the height of the users, particularly children.

Without departing from the invention, it is also possible to use any other means allowing the displacement of the lower portion of the legs 19 and 19' of the scissor elements 17 in the transverse or, if necessary, longitudinal direction. Thus, as shown in FIGS. 10 to 13, the base of the legs 19 and 19' is supported so as to swivel in two carriages 98 and 98', respectively, which are arranged so as to be supported on the bottom 7 of the swimming pool and which can be displaced relative to one another to regulate the distance between the bases of the respective legs 19 and 19'.

In FIGS. 10 to 13, the carriages 98 and 98' extend in the transverse direction of the basin 1 and are integral with two opposite and parallel longitudinal constructions 100 and 100'. The constructions 100 and 100' are enclosed by two members 101 which are held at a distance from one another by a plurality of cross-pieces 102 imparting the necessary rigidity to the construction 100, 100'. The carriages 98, 98' are metal frames which are fixed at the respective constructions 100, 100' and include two transverse arms 103 which are connected by crossbars 104. The carriages 98, 98' are arranged on the constructions 100, 100' in such a way that they alternate in the longitudinal direction, that is, they are associated with first one, then the other construction 100 and 100' in succession. The respective bases of the legs 19 and 19' of a scissor element 17 are supported respectively on the adjacent arms 103 belonging to the carriages 98, 98' integral with the opposite constructions 100 and 100' in such a way that a relative displacement of the latter effects a displacement of said bases.

For this purpose, as shown in FIG. 11, each arm 103 is penetrated by a vertical hole receiving an axle 106, on the upper part of which is arranged a cap 108 in which the base of a leg 19, 19' is fixed so as to be articulated around an axle 110. A pin 112 holds the cap 108 in place on the arm 103. The crossbar 104 which is formed by a cylindrical member is fixed, e.g. by means of solder, on the arm 103 and receives a roller 114 in the vicinity of the cap 108, which roller 114 is supported on the bottom 7 and ensures a smooth displacement of the carriage 98, 98' on the bottom 7. In order to ensure a relative parallel displacement of the carriages 98 and 9', the arms 103 are provided with external guide rollers 116 on a vertical axis which are to be supported on the arms 103 of an adjacent carriage 98, 98'.

The two opposite constructions 100 and 100' are moved toward or away from one another to allow the relative displacement of the bases of the legs 19 and 19'. This displacement can be realized by any appropriate known means such as hydraulic jacks, an endless screw or worm arrangement, etc.

However, it will be noted that the present system does not allow for a control of the displacement of the scissor elements 17' disposed at the longitudinal ends of the basin 1. When the cover arrangement is not intended to withstand heavy loads, a slight overhang is allowed at the longitudinal ends of the structure 9.

In the other event, an arrangement such as that shown in FIGS. 10 to 13 could be realized for ensuring the control of the outer scissor elements 17'. In such an embodiment form, the outermost leg (in this case leg 19') is articulated by its base on a cap 120 fixed on the bottom 7 of the basin 1. The base of the other leg 19 in turn is provided with a roller 121 which can be displaced in a U-shaped guide rail 122 fixed at the bottom 7.

The base of the leg 19 is connected to a flexible metal cable 123 which winds around a first pressure pulley 124 secured at the base of the longitudinal wall 5 of the basin 1 and then around a second pressure pulley 126 secured at the front part of the construction 100 so as to be fixed at a point of attachment 125 of the vertical wall 5 located under the first pressure pulley 124.

In this case it can be seen that every displacement of the construction 100 toward the interior by a distance equal to d will bring about a displacement of the roller 121 toward the vertical wall 5 by a distance equal to twice this displacement, namely *2d*. The relative displacement *2d* of the bases of the legs 19 and 19'' belonging to the outer scissor elements 17' is thus equal to the relative displacement of the bases of the other scissor elements 17. A spring 130 arranged between the legs 19, 19' above the axis 21 ensures that the legs 19, 19' will move apart when the construction 100 is moved back toward the vertical wall 5 of the basin 1.

Of course, any other arrangement ensuring a relative displacement of the base of the legs 19, 19' forming the outer scissor elements 17', which is identical to that of the other scissor elements 17, could likewise be used according to the invention.

The partitions formed by the ribs 14 of the longitudinal 11 and transverse 13 members of the support structure 9 are closed by shutters 70. In order to facilitate the vertical displacement of the cover inside the swimming pool when the latter is filled with water, means are employed which make it possible to reduce the resistance against the displacement of this cover. To this end, the shutters 70 which are arranged along the same transverse line in the present example are integral with an axle 72 rotatably supported in the holes 73 provided in the ribs 14 of the transverse members 13. The axles 72 are preferably provided with control means, in this case gears 75, which set them in rotation in one direction or the other so as to move the shutters 70 into the open or closed position.

In an advantageous manner, the shutters 70 overlap in at least one direction. Thus, in FIG. 9, the shutters 70 include two identical grooves, namely a first groove 71 which is constructed in the upper rear face of a shutter 70 above the rotational axle 72 and is parallel to the latter, and a second groove 73 which is constructed in the lower front face of the shutter 70 and is parallel to the first groove 71. Thus, as shown in FIG. 9, the shutters 70 can overlap simultaneously the longitudinal and transverse directions so as to form a standardized application plane. The shutter 70 thus constitutes a solid body with parallel lower and upper faces 69*a* and 69*b*, respectively. The rear face of this solid body is formed by a vertical wall 70*a* which extends upward to a height h approximately equal to half of its total height H and by a wall 70*b* which is inclined at approximately 45° relative to the upper face 69*b* and which extends toward the interior of the latter. The front part of the shutter 70 has a shape complementing that of its rear part in such a way that it can be inserted in the rear part of a shutter 70 situated in front of it. The right-hand portion of the shutter 70, as viewed from the rear, is recessed to a depth b by a groove 74 which is inclined relative to the upper and lower faces and extends from the upper front part of the shutter 70 to the upper part of the vertical wall 70*a*. The shutter 70 is recessed on its opposite left-hand face by a complementary groove in such a way that it allows the left-hand portion of the shutter to overlap the groove 74 of an adjacent shutter situated to its left.

The sealing shutters 70 can be constructed from a solid material as well as from a hollow material or from a soft, less dense material which, being lighter than water, automatically occupies the vertical open position when submerged.

The present invention as shown in FIG. 14 allows a realization of a basin cover in swimming pools whose bottom 7 slopes in one direction, i.e. in the longitudinal direction in the present example. In this case, the means for ensuring the vertical displacement of the support structure 9 must permit the latter to be horizontal when located on the surface and sloping when resting on the bottom 7. Therefore, the vertical displacement means of the support structure 9 must be capable of swiveling the latter in the course of its vertical displacement. When the vertical displacement means are formed by scissor elements 17, the upper ends of the legs 19, 19' forming the scissors which are arranged in the deepest part of the basin 1 must be subjected to a vertical displacement greater than the displacement of its lower part in the horizontal direction so as to compensate for the difference in depth.

For this purpose, the distance a between the axes 21 and the upper part of the legs 19, 19' must be adjusted and the latter are arranged, as shown in FIG. 14, in such a way that the greater the significance of the depth of the basin relative to the straight line of a given scissor element 17, the greater the value given to the distance a.

of course, the legs 19 and 19' forming the scissor elements 17 can be adjustable with respect to length. To this end, as shown in FIG. 15, they can include a main hollow body 19*a*, 19*a'* in which a rod 19*b*, 19*b'* receiving the rollers 35, 35' and 37, 37' slides. A pin 20, 20' (see FIG. 15) passing through these two elements makes it possible to adjust the desired height.

The partitioning of the support structure 9 can be formed either by the upper ribs 14 or by the members themselves and it can also be formed by a succession of parallel elements which can extend in one of the longitudinal or transverse dimensions of the swimming pool. Likewise, each of the partitions can be overlapped by one or more movable shutters 70.

I claim:

1. A rigid cover arrangement for a swimming pool having a basin (1), said cover arrangement being movable vertically inside the basin (1) between two extreme positions, one of said extreme positions being a bottom (7) and the other of said extreme positions being the surface of the pool, said rigid cover arrangement comprising:

sealing shutters (70) movably supported on a support structure (9) and means for providing for movement of said sealing shutters between an open position and a closed position;

said support structure (9) being planar and rigid and forming a plurality of partitions, each of said partitions being sealable by at least one of said shutters (70);

displacement means for positioning and maintaining the supporting structure (9) in at least a third position situated between said extreme positions; and means for placing said sealing shutters (70) in said closed position when said supporting structure (9) is in said third position.

2. The movable cover arrangement according to claim 1, including vertical displacement means comprising a plurality of scissor elements (17), said scissor elements each having two articulated legs (19, 19') provided with upper ends slidable in said support structure (9) and supporting said articulated legs, said articulated legs each having a lower end or a base supported at the bottom (7) of the basin (1) on movable members (51, 53), respectively situated in the plane of said bottom (1) and for permitting said support structure (9) to be raised responsive to movement of said lower ends toward one another or lowered by moving said lower ends apart.

3. The cover arrangement according to claim 2, wherein said legs (19, 19') forming the scissor elements (17) include a rod (19*b*, 19*b'*) and are formed by a main hollow body (19*a*, 19*a'*) and said rod (19*b*, 19*b'*) slides within said hollow body, said rod (19*b*, 19*b'*) receives the rolling means arranged at the upper part of the legs (19, 19') and holding means (20, 20') being provided for securing the rod (19*b*, 19*b'*) in the main hollow body (19*a*, 19*a'*) at the desired height.

4. The cover arrangement according to claim 2, including parallel carriages (98, 98'), said movable members including two opposite constructions (100, 100') disposed opposite and parallel to one another and extending in one of the longitudinal or transverse directions of the basin (1), said parallel carriages (98, 98') being fixed on and extending perpendicular to the constructions (100, 100') and alternate relative to each other so that two adjacent carriages (98, 98') are associated with said two opposite constructions (100, 100'), respective bases of the legs (19, 19') of one and the same scissor element (17) being supported in an articulated manner on said two adjacent carriages (98, 98') so that all relative parallel displacement (d) of the two constructions (100, 100') causes an identical displacement (d) of the bases of the legs (19, 19').

5. The cover arrangement according to claim 4, wherein each of said carriages (98, 98') include outer guide rollers (116) on vertical axes for support on the adjacent carriage of said carriages (98, 98').

6. The cover arrangement according to claim 4, wherein said carriages (98, 98') are each formed by a frame having two arms (103) integral with the constructions (100, 100') which extend toward the interior perpendicular to the latter and are joined by at least one crossbar (104).

7. The cover arrangement according to claim 4, wherein said legs of the outermost scissor elements (17') includes an outermost part, means for supporting one of said legs (19) at said outermost part in an articulated manner on a fixed element (20) fixed with respect to the bottom (7) of the basin (1), and means for supporting the base of the other leg (19) for slidable movement relative to the bottom (7), flexible connecting means (123) for connecting said base at a fixed point thereon relative to the basin (1) situated to the rear of said fixed element (120) with the intermediary of two pressure pulleys, one of said pressure pulleys being a first, outer pressure pulley (124) fixed relative to the basin (1) and the other of said pressure pulleys being a second pressure pulley (126) arranged at the front part of the construction (100, 100') so that every displacement (d) of the construction (100, 100') corresponds to a displacement (2*d*) of the base of the leg (19) of the outer scissor element (17') which is twice as great as the latter (d).

8. The cover arrangement according to claim 4, including rollers (114) for supporting said carriages (98, 98') on the bottom (7) of the basis (1).

9. The cover arrangement according to claim 8, including a crossbar (104) for supporting said rollers (114), one of the inner ends of said crossbar (104) supports the means of articulation of the base of each said leg (19, 19').

10. The cover arrangement according to claim 9, wherein said support structure (9) is formed by longitudinal members (11) and transverse members (13) having an apparent density close to 1, the lower part of the transverse members (13) having a hollow profiled member (25) forming a slide for receiving at least one roller (35, 35'; 37, 37').

11. The cover arrangement according to claim 2, wherein said support structure (9) is formed by longitudinal members (11) and transverse members (13) having an apparent density close to 1, the lower part of the longitudinal members (11) having a hollow profiled member (25) forming a slide for receiving at least one roller (35, 35'; 37, 37') arranged at the upper part of each said leg (19, 19').

12. The cover arrangement according to claim 11, wherein said shutters (70) are integral with axles (72) and said axles (72) being parallel to one another and coupled with rotational drive means (75).

13. The cover arrangement according to claim 12, wherein said shutters (70) are shaped so that they overlap in the longitudinal and/or transverse direction.

14. The cover arrangement according to claim 13, wherein said legs (19, 19') forming the scissor elements (17) include a rod (19*b*, 19*b*') and a main hollow body (19*a*, 19*a*') and said rod (19*b*, 19*b*') being slidable within said hollow body, said rod (19*b*, 19*b*') receiving the rolling means located at an upper part of the legs (19, 19') and holding means (20, 20') for securing said rod (19*b*, 19*b*') in said main hollow body (19*a*, 19*a*') at a desired height.

15. The cover arrangement according to claim 1, wherein said shutters (70) are formed from a material having an apparent density less than 1.

16. The cover arrangement according to claim 15, wherein said shutters (70) are shaped so that they overlap in at least one of the longitudinal and transverse directions.

17. The cover arrangement according to claim 15, wherein each of said legs of the outermost scissor elements (17') includes a base, the base of one of said legs (19') being supported in an articulated manner on a fixed element (20) fixed with respect to said bottom (7) of said basin (1), and the base of said other leg (19) being supported for slidable movement relative to said bottom (7), and flexible connecting means (123) for connecting said base of said other leg (19) at a fixed point relative to said basin (1) situated to the rear of a fixed element (120) with the intermediary of two outer pressure pulleys (124, 126), one of said outer pressure pulleys being a first pressure pulley (124) fixed relative to said basin (1) and the other of said outer pressure pulleys being a second pressure pulley (126) located at the front part of said construction (100, 100') so that every displacement (d) of said construction (100, 100') corresponds to a displacement (2*d*) of the base of said leg (19) of said outer scissor element (17') which is twice as great as the displacement (d) of said construction (100, 100').

18. A rigid cover arrangement for a swimming pool having a basin (1), said cover arrangement being movable vertically inside the basin (1) between two extreme positions, one of said extreme positions being a bottom (7) and the other of said extreme positions being the surface of the pool, said rigid cover arrangement comprising:

sealing shutters (70) movably supported on a support structure (9) for movement between an open position and a closed position;

said support structure (9) being planar and rigid and forming a plurality of partitions, each of said partitions being sealable by at least one of said shutters (70); and displacement means positioning and maintaining the supporting structure (9) in at least a third position situated between said extreme positions;

said support structure (9) comprising a plurality of scissor elements (17), each of said scissor elements (17) having two articulated legs (19, 19'), said articulated legs each having a lower end or a base supported at the bottom (7) of said basin (1) on movable members (51, 53), respectively situated in the plane of said bottom (1);

said movable members (51, 53) including two opposite constructions (100, 100') disposed opposite and parallel to one another and extending in one of the longitudinal or transverse directions of said basin (1); and parallel carriages (98, 98') fixed on and extending perpendicular to the constructions (100, 100') and alternate relative to each other so that two adjacent carriages (98, 98') are associated with said two opposite constructions (100, 100'), respective bases of said legs (19, 19') of one and the same scissor element (17) being supported in an articulated manner on said two adjacent carriages (98, 98') so that all relative parallel displacement (d) of the two constructions (100, 100') causes an identical displacement (d) of the bases of the legs (19, 19').

19. A rigid cover arrangement for a swimming pool having a basin (1), said cover arrangement being movable vertically inside the basin (1) between two extreme positions, one of said extreme positions being a bottom (7) and the other of said extreme positions being the surface of the pool, said rigid cover arrangement comprising:

sealing shutters (70) movably supported on a support structure (9) for movement between an open position and a closed position;

said support structure (9) being planar and rigid and forming a plurality of partitions, each of said partitions being sealable by at least one of said shutters (70), said shutters (70) being integral with axles (72) and said axles (72) being parallel to one another and coupled with rotational drive means (75); and displacement means positioning and maintaining said supporting structure (9) in at least a third position situated between said extreme positions.

* * * * *